US006688660B2

(12) United States Patent
Huang

(10) Patent No.: US 6,688,660 B2
(45) Date of Patent: Feb. 10, 2004

(54) DOOR LOCK

(75) Inventor: Chao-Ming Huang, Kaohsiung Hsien (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 0 days.

(21) Appl. No.: 10/170,553

(22) Filed: Jun. 14, 2002

(65) Prior Publication Data

US 2003/0230903 A1 Dec. 18, 2003

(51) Int. Cl.[7] ..... E05B 9/00

(52) U.S. Cl. ..... 292/337; 292/1.5; 292/DIG. 60; 292/DIG. 64

(58) Field of Search ..... 292/1.5, 337, DIG. 60, 292/DIG. 64

(56) References Cited

U.S. PATENT DOCUMENTS 4,687,239 A * 8/1987 Lin ..... 292/172
4,708,379 A * 11/1987 Ching ..... 292/1.5
4,890,871 A * 1/1990 Lin ..... 292/337
4,927,199 A * 5/1990 Wu et al. ..... 292/1.5
5,020,837 A * 6/1991 Lin ..... 292/169.13
5,074,605 A * 12/1991 Fann et al. ..... 292/337
5,149,151 A * 9/1992 Shen ..... 292/1.5
RE34,240 E * 5/1993 Lin ..... 292/337
5,257,838 A * 11/1993 Lin ..... 292/1.5
5,354,109 A * 10/1994 Lin ..... 292/1.5
5,498,037 A * 3/1996 Fan Lai ..... 292/1.5
5,551,264 A * 9/1996 Fann et al. ..... 70/134
6,186,562 B1 * 2/2001 Huang ..... 292/169
6,293,597 B1 * 9/2001 Huang ..... 292/1.5
6,536,816 B1 * 3/2003 Fan ..... 292/337

* cited by examiner

*Primary Examiner*—J. J. Swann
*Assistant Examiner*—Carlos Lugo
(74) *Attorney, Agent, or Firm*—Bacon & Thomas, PLLC

(57) ABSTRACT

A door lock includes a tubular casing having a front end-plate covered with a panel. The casing receives a bolt, a linking piece, a trigger and a tumbler therein, with the bolt connected to a slider through the linking piece. The slider has two pairs of cogs, and is movable between two opposite guides. An annular follower is positioned in the guides and has a pair of paws for selectively pushing the pairs of cogs in order to move the slider and hence the bolt backward. The slider further has a pair of indentations and one guide have a pair of teeth engagable with rear ends of the indentations when the bolt is fully extended, so as to provide the bolt with an extended position independent from the panel. Additionally, the guide has two pairs of opposite stops located between the pairs of cogs.

6 Claims, 5 Drawing Sheets

DOOR LOCK

BACKGROUND OF THE INVENTION

1. Field of the Invention

The present invention relates to a door lock and, more particularly, to a door lock which can be assembled smoothly and correctly.

2. Description of Related Art

As shown in FIG. 1, there is a door lock that includes a tubular casing 90 having a front end-plat 901 covered with a panel 900, for the purpose of receiving a bolt 91, a linking piece 92, a trigger 93 and a tumbler 94 therein.

The bolt 91 is connected to the linking piece 92, which is in turn connected to a slider 97 by a clip ring 96. The slider 97 has two pairs of opposite cogs 971, 972, with each pair being adapted to mesh with paws 981 of an annular follower 98 rotatably positioned in aligned holes 991 of a rear cover 99. The rear cover 99 can be moved, relative to opposite guides 90*a*, 90*b*, to such positions that the paws 981 of the follower 98 may mesh with the cogs 971 or cogs 972. When the follower 98 is turned, the paws 981 push the cogs 971, 972, so as to move the slider 97 and hence the bolt 91 backward. The bolt 91 will return by the action of compressed springs 95 immediately after the follower 98 is released.

In the conventional door lock, it is the panel 900 that defines a furthest or extended position for the bolt 91. When the lock is being assembled, the panel 900 must be held on the front end-plate 901, such as with rubber bands, to confine the spring-loaded bolt 91 and trigger 93 in the casing 90 before the panel 900 is riveted to the plate 901. If the front panel 900 is separated undesirably from the front end-plate 901, the bolt 91 and then the trigger 93 will move further forward.

The tumbler 94 is then turned by the action of the spring 95 and its hooked front end 941 will not be pressed against a protrusion 931 of the trigger 93 but be moved to the back of the protrusion 931 instead, thus blocking the way the trigger 93 and the bolt 91 may be moved back. The door lock is useless unless it is dismantled and the assembling process is repeated.

In addition, it is usual to find that the annular follower 98 is placed so incorrectly that one of its paws 981 projects outward from the cogs 971, 972 of the slider 97, as shown in FIG. 2. The non-rotatable follower 98 results in a useless lock.

OBJECT OF THE INVENTION

The object of the present invention is to provide a door lock which can be assembled smoothly.

Another object of the present invention is to provide a door lock which can be assembled correctly.

SUMMARY OF THE INVENTION

An improved door lock includes a tubular casing that has a front end-plate covered with a front panel in order to receive and confine a bolt, a linking piece, a spring-loaded trigger and a tumbler in the casing. The bolt is movable in the tubular casing between an extended position and a retracted position, and is spring-loaded in such a way that it tends to be moved to the extended position. The spring-loaded trigger has a front end normally extended out of the casing, and the tumbler is adapted to retain the bolt in the extended position when the front end of the trigger is depressed while the bolt is moved to the extended position.

Two opposite guides are situated behind the tubular casing and joined together. The guides are formed with respective grooves aligned with each other, with a slider movable between the guides forward and backward. The slider is connected to the bolt through the linking piece and is formed with a first pair of opposite cogs and a second pair of opposite cogs. An annular follower is positioned in place in the groves of the guides and has a pair of paws for selectively pushing the pairs of opposite cogs, thereby moving the slider and hence the bolt backward as the follower is turned.

In the present invention, the slider has a pair of indentations defined therein while one of the guides have a pair of teeth engagable with rear ends of the indentations when the bolt is fully extended. This provides the bolt with an extended position independent from the front panel.

Furthermore, one of the guides is additionally formed with a first pair of opposite stops and a second pair of opposite stops, with the first pair of opposite stops located between the first and second pairs of cogs and the second pair of opposite stops located behind the second pair of cogs when the bolt is in its extended position.

In a preferred embodiment, the slider further has a pair of notches formed at a front end thereof and a clip ring is held both around a heck of the linking piece and in the notches of the slider, so as to connect the slider to the linking piece.

In a highly preferred embodiment, there is a rear cover having a pair of aligned through-holes in which annular follower is rotatably positioned. The rear cover is situated behind the tubular casing in either one of two positions, including a first position in which the paws of the annular follower may push the fist pair of opposite cogs, and a second position in which the paws of the annular follower may push the second pair of opposite cogs.

Other objects, advantages and novel features of the invention will become more apparent from the following detailed description when taken in conjunction with the accompanying drawings.

DETAILED DESCRIPTION OF THE PREFERRED EMBODIMENT

Figure 1:
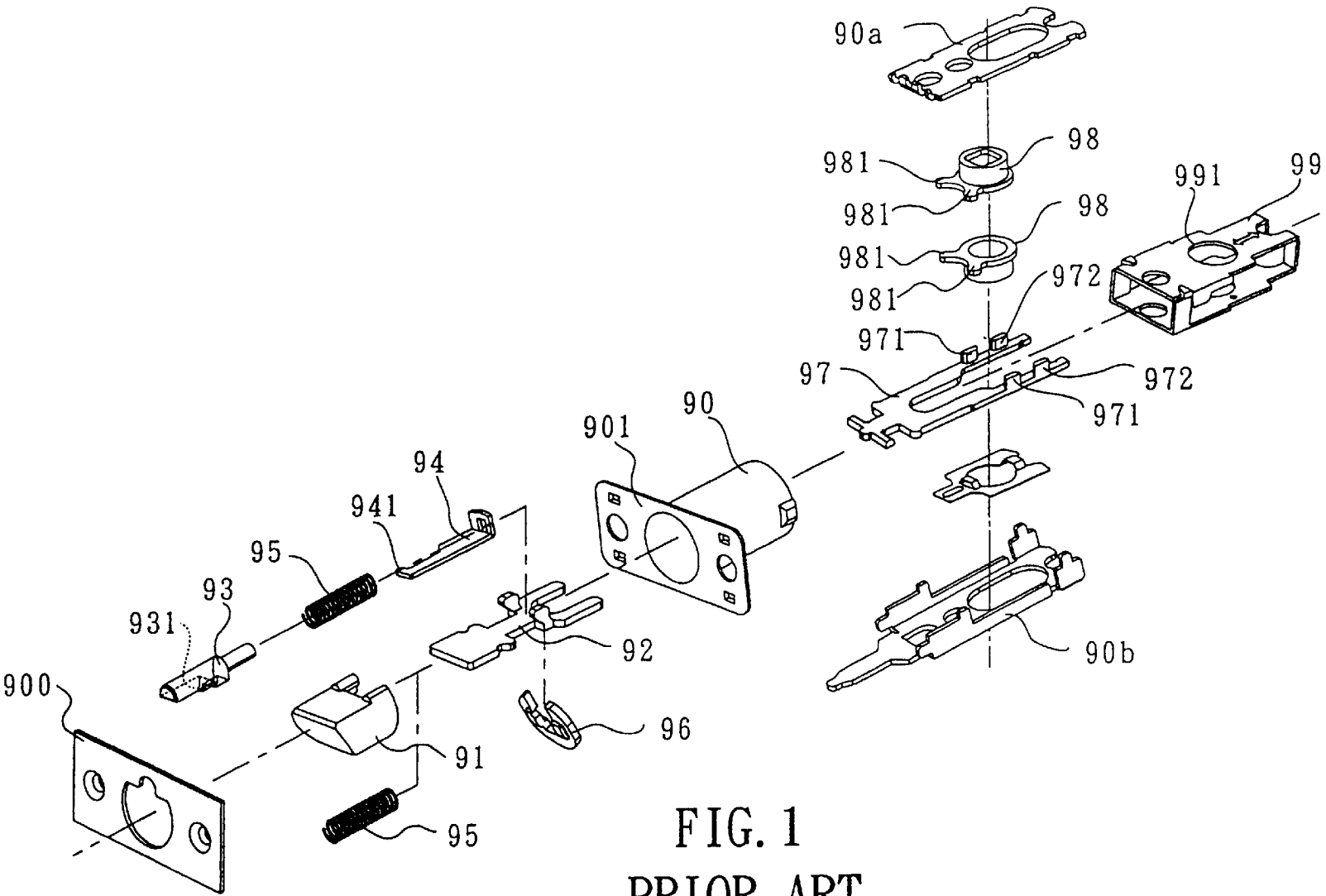
FIG. 1 PRIOR ART
FIG. 1 is an exploded perspective view of a conventional door lock.
Figure 2:
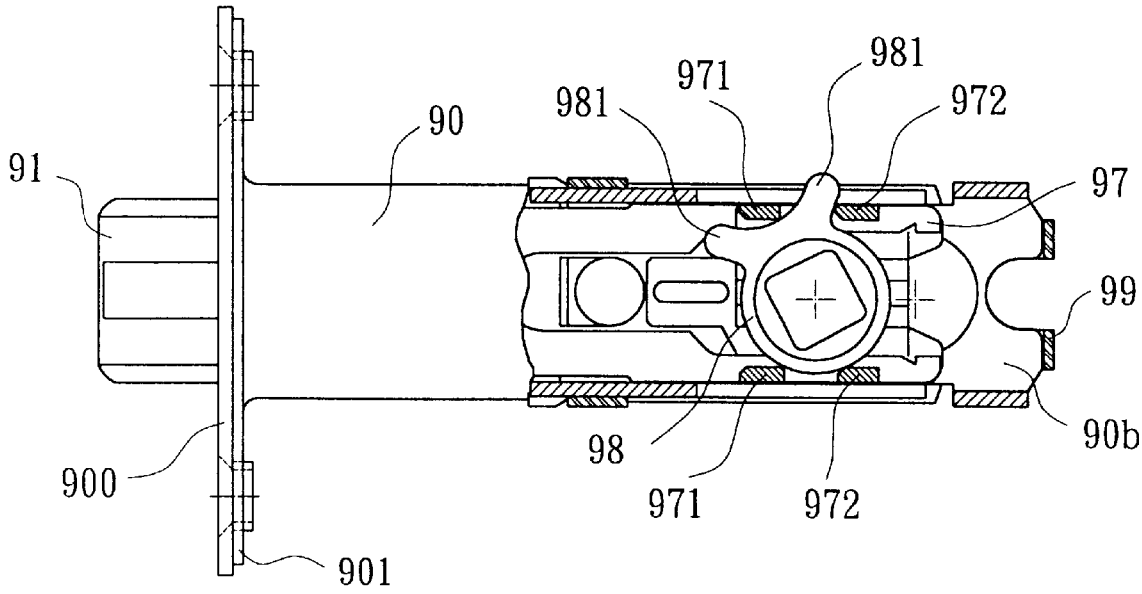
FIG. 2 PRIOR ART
FIG. 2 is a cross-sectional top view of the door lock of FIG. 1, showing an annular follower placed incorrectly.
Figure 3:
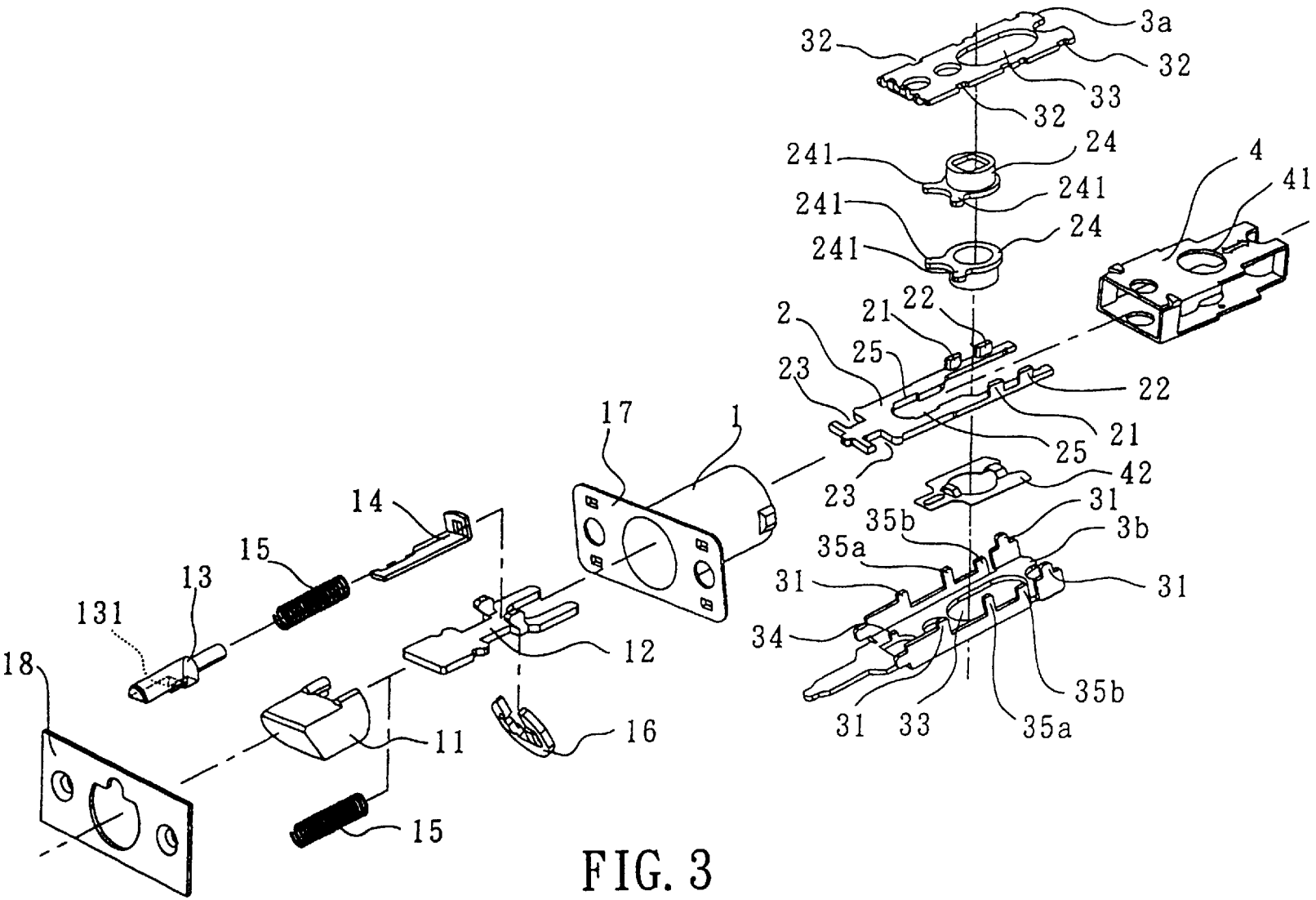
FIG. 3 is an exploded perspective view of a door lock in accordance with the present invention.

Referring to FIG. 3, a preferred embodiment of a door lock in accordance with the present invention includes a tubular casing 1 having a front end-plate 17 covered with a front panel 18. The tubular casing 1 is provided for receiving a bolt 11, a linking piece 12, a spring-loaded trigger 13 and a tumbler 14.

The bolt 11 is movable in the casing 1 between an extended position and a retracted position and is spring-loaded, such as by a first spring 15, in such a way that the bolt 11 tends to be moved to its extended position.

The trigger 13, disposed movably between two top noses of the bolt 11, has a front end that is normally extended out of the front panel 18 due to a second spring 15 compressed between the trigger 13 and an angled rear end of the tumbler 14. The trigger 13 is formed with a protrusion 131 usually abutting a rear face of the bolt 11. Whenever the bolt 11 is moved either frontward or backward, the trigger 13 follows, except when the front end of the trigger 13 has been depressed, especially by a doorframe if the door is closed.

Figure 5:
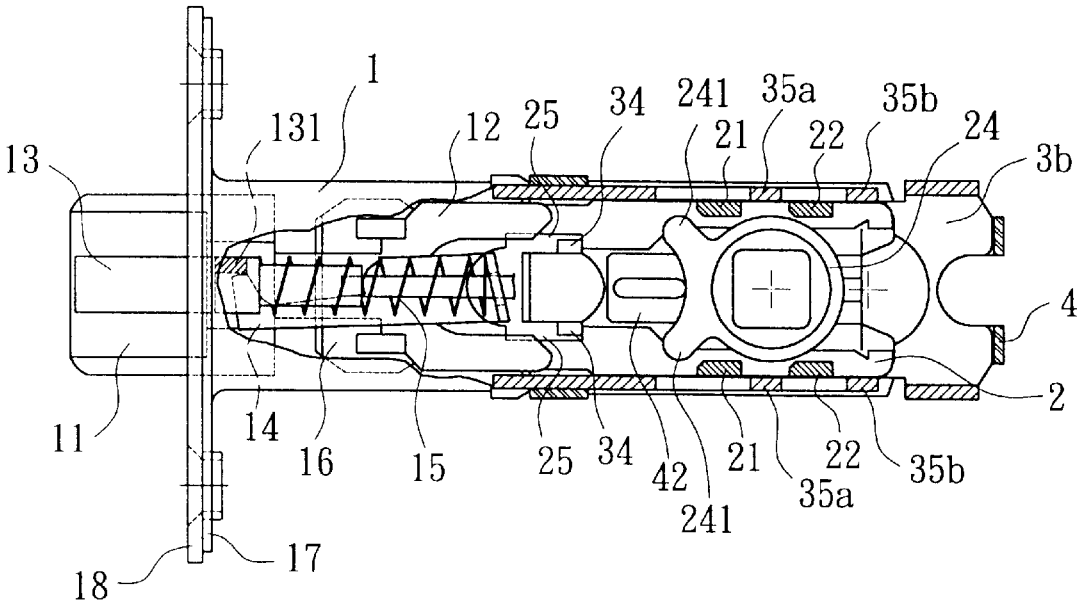
FIG. 5 is a cross-sectional top view taken along lines 5—5 in FIG. 4.

The tumbler 14 has a hooked front end normally pressed against the protrusion 131 of the trigger 13, as best seen in FIG. 5. If the door is being closed, the front end of the trigger 13 is depressed while the bolt 11 is moved to the extended position. It is at this time that the tumbler 14 will be turned about its angled rear end, by the action of the compressed second spring 15, and the hooked front end of the tumbler 14 will be moved so as to block the way the bolt 11 may be moved backward. The bolt 11 is then retained in its extended position and so no picklock can open the door with a thin strip.

Referring still to FIG. 3, the bolt 11 is connected to a slider 2, through the linking piece 12. The slider 2, having a pair of notches 23 formed at a front end thereof, is connected to the linking piece 12, by means of a clip ring 16 held both around a neck of the linking piece 12 and in the notches 23 of the slider 2. This clip ring 16 serves as a lever which may increase the backward motion imparted from the slider 2 to the linking piece 12 and, in turn, to the bolt 11.

The slider 2 is further formed with two pairs of opposite cogs 21, 22, one pair behind another, and with a pair of indentations 25 defined therein on sides of a central slot (not numbered). A hole-blocking piece 42 is movably positioned in the central slot of the slider 2.

Furthermore, the slider 2 is movable forward and backward between two opposite guides 3*a*, 3*b* which are situated behind the tubular casing 1 and joined together. In the illustrated embodiment, the upper guide 3*a* has a plurality of cutouts 32 defined in side edges thereof, while the lower guide 3*b* has a plurality of protuberances 31 that are placed in the cutouts 32 before being bent. These bent protuberances 31 ensure the interconnection of the two guides 3*a*, 3*b*.

The guides 3*a*, 3*b* are formed with respective grooves 33 aligned with each other for guiding an annular follower 24. The annular follower 24, preferably consisting of two halves coupled together, is positioned in place in the groves 33 of the guides 3*a*, 3*b*, and has a pair of paws 241 for selectively pushing the pairs of opposite cogs 21, 22, so as to move the slider 2 backward and hence the bolt 11 toward the retracted position.

Figure 4:
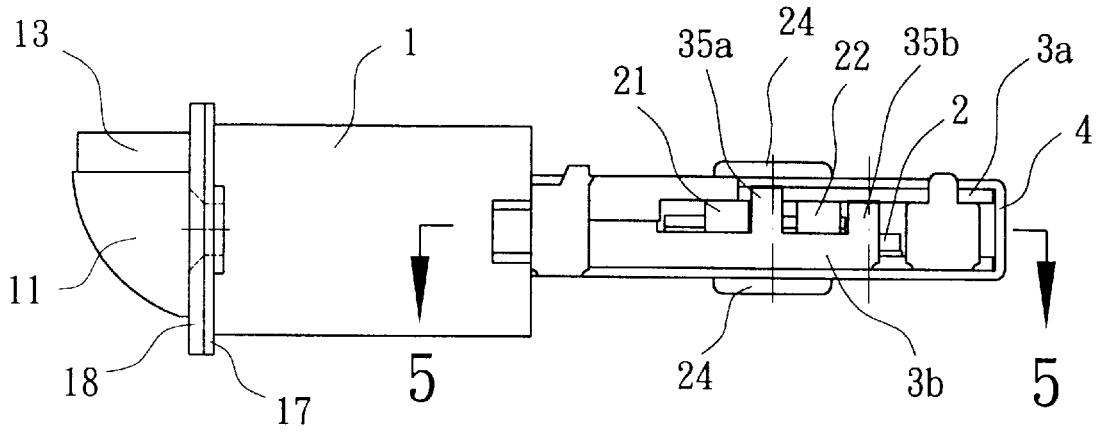
FIG. 4 is a front view of the door lock of FIG. 3.

The inventive door lock further includes a rear cover 4 situated behind the tubular casing 1 for housing the guides 3*a*, 3*b*, as best shown in FIG. 4. The rear cover 4 has a pair of aligned through-holes 41 in which the annular follower 24 is rotatably positioned.

Referring to FIG. 5, the rear cover 4 is designed to be situated behind the tubular casing 1 in either one of two positions, including a first position and a second position.

If the cover 4 is situated in its first position, the annular follower 24 is centered on a point designated by a cross hair on the left hand-side, and either paw 241 of the follower 24 may push one of the opposite cogs 21 backward. If the cover 4 is situated in its second position, the annular follower 24 is centered on another point designated by a cross hair on the right hand-side, and either paw 241 of the follower 24 may push one of the opposite cogs 22 instead.

In the inventive door lock, it is to be noted that one of the guides 3*a*, 3*b*, for example, the lower guide 3*b*, has a pair of teeth 34 engagable with a rear end of the indentation 25 of the slider 2 when the bolt 11 is fully extended, as clearly shown in FIG. 5. This engagement provides the bolt 11 with an extended position independent from the front panel 18.

Therefore, the spring-loaded bolt 11 is kept in its extended position even if the front panel 18 is separated undesirably from the front end-plate 17 during the assembling process of the door lock. Being abutting the rear face of the bolt 11, the protrusion 131 of the trigger 13 is also kept in its right place without any possibility of moving further forward. The hooked front end of the tumbler 14 is now pressed exactly against the protrusion 131 of the trigger 13, incapable of being moved to the back of the protrusion 131. This enables the assembling process to be carried out smoothly.

In the inventive door lock, it is also to be noted that one of the guides 3*a*, 3*b*, for example, the lower guide 3*b*, has two pairs of opposite stops 35*a*, 35*b*: one pair of stops 35*a* is located between the pairs of cogs 21, 22 and the other pair of stops 35*b* is located behind the pair of cogs 22 whenever the bolt 11 is in its extended position.

Figure 6:
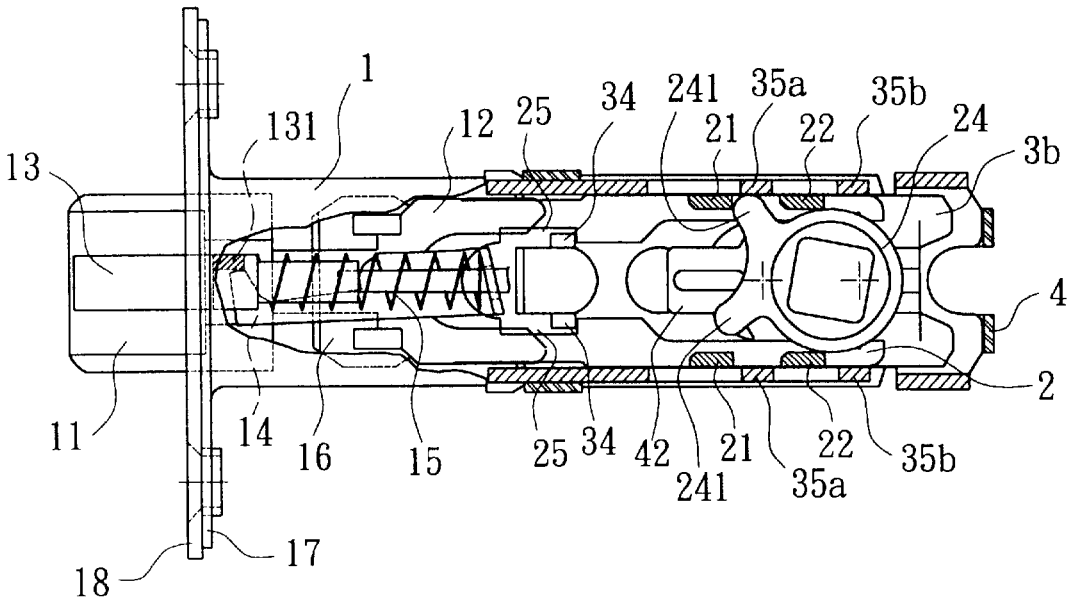
FIG. 6 is a cross-sectional top view of the door lock of FIG. 3, showing an annular follower placed incorrectly.

Referring to FIG. 6, during the assembling process, these stops 35*a*, 35*b* prevent either paw 241 of the follower 24 from projecting outward from the cogs 21, 22. If the annular follower 24 is placed incorrectly in the guides 3*a*, 3*b*, it is centered only on a point off the cross hairs. This is a situation which can be quickly found for the rest parts of the door lock can not be attached to those already assembled. In one word, the stops 35*a*, 35*b* enable the door lock to be assembled correctly.

Figure 7:
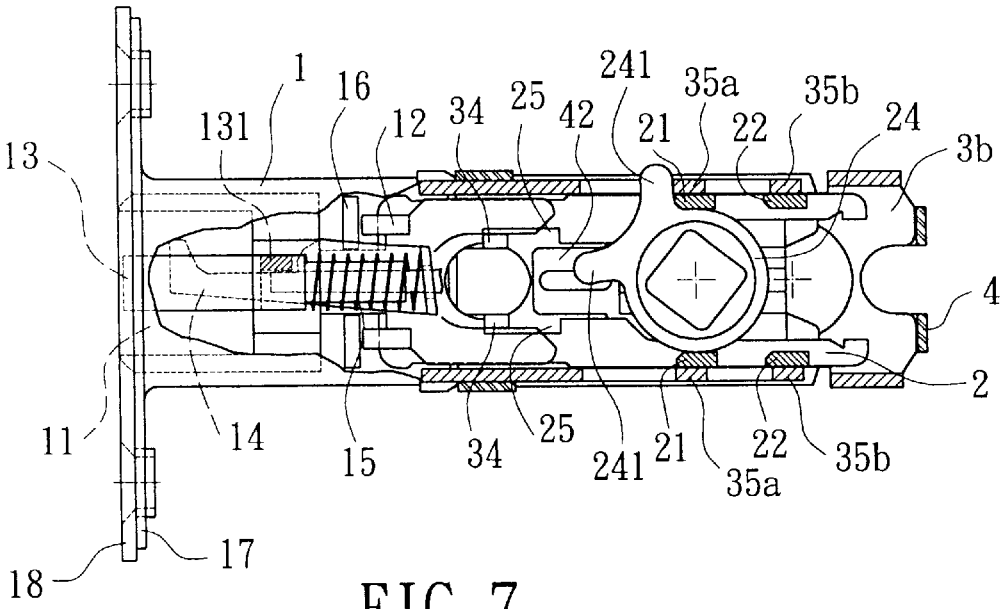
FIG. 7 is a cross-sectional top view of the door lock of FIG. 3, showing a paw of the annular follower engaged with one of stops.

Referring to FIG. 7, either paw 241 of the annular follower 24 is engaged with one of the stops 35*a*, 35*b* at the moment when the bolt 11 is moved to its retracted position. This means that the stops 35*a*, 35*b* may prevent the excessive rotation of the annular follower 24.

From the foregoing, it is apparent that this invention has the advantages of enabling the door lock to be assembled easily and correctly.

While the principles of this invention have been disclosed in connection with an specific embodiment, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A door lock comprising:

a tubular casing having a front end-plate covered with a front panel;

a bolt movable in said tubular casing between an extended position and a retracted position, said bolt being spring-loaded and tending to be moved to said extended position;

a spring-loaded trigger received in said tubular casing, said trigger having a front end normally extended out of said casing;

a tumbler received in said tubular casing, said tumbler being adapted to retain said bolt in said extended position when said front end of said trigger is depressed while said bolt is moved to said extended position;

two opposite guides situated behind said tubular casing and joined together, said guides being formed with respective grooves aligned with each other;

a slider movable between said guides forward and backward, said slider being formed with a first pair of opposite cogs and a second pair of opposite cogs;

a linking piece connecting said bolt to said slider;

an annular follower positioned in place in said grooves of said guides, said follower having a pair of paws for selectively pushing said pairs of opposite cogs so as to move said slider and hence said bolt backward; and wherein said slider has at least one indentation defined therein while one of said guides have at least one tooth engageable with a rear end of said indentation when said bolt is fully extended, thereby providing said bolt with said extended position.

2. The door lock as claimed in claim 1, wherein said slider has a pair of notches formed at a front end thereof, and wherein a clip ring is held both around a neck of said linking piece and in said notches of said slider and connect said slider to said linking piece.

3. The door lock as claimed in claim 1 further including a rear cover situated behind said tubular casing for housing said guides.

4. The door lock as claimed in claim 3, wherein said rear cover has a pair of aligned through-holes defined therein, and wherein said annular follower is rotatably positioned in said through-holes of said rear cover.

5. The door lock as claimed in claim 4, wherein said rear cover is situated behind said tubular casing in either one of two positions, including a first position in which said paws of said annular follower may push said first pair of opposite cogs, and a second position in which said paws of said annular follower may push said second pair of opposite cogs.

6. The door lock as claimed in claim 1, wherein said annular follower comprises two halves coupled together.

* * * * *